United States Patent [19]

Bedient

[11] Patent Number: 5,075,898

[45] Date of Patent: Dec. 31, 1991

[54] VISOR CAP WITH RETRACTABLE PROTECTIVE VISOR

[76] Inventor: Jack R. Bedient, 601 E. No. Lights 122, Anchorage, Ak. 99503

[21] Appl. No.: 429,619

[22] Filed: Jan. 8, 1990

[51] Int. Cl.[5] ..... A42B 1/06

[52] U.S. Cl. ..... 2/10; 2/195

[58] Field of Search ..... 2/10, 195

[56] References Cited

U.S. PATENT DOCUMENTS

| | | | |
|---|---|---|---|
| 566,326 | 8/1896 | Kirshner | 2/195 |
| 716,258 | 12/1902 | Maass | 2/195 |
| 1,610,745 | 12/1926 | Castanaro | 2/10 |
| 2,004,471 | 6/1935 | David | 2/10 |
| 3,837,005 | 9/1974 | Persson | 2/199 |
| 4,793,006 | 12/1988 | Dawson | 2/195 |

*Primary Examiner*—Thomas B. Will

*Attorney, Agent, or Firm*—Michael J. Tabella

[57] ABSTRACT

A cap having a domed shaped crown and an extendible visor is disclosed. The visor extends from the lower edge of the domed crown and consists of a first visor consisting of a top piece and a bottom piece that are attached together with a space in between, which forms a pocket. The pocket holds a second visor which can be extended from the first visor to provide added protection from the sun or rain. The second visor can be retracted if necessary to enhance vision. A system of slots and pins restricts the inward and outward movement of the second visor. The second visor is held in place once fully extended or retracted, by friction.

3 Claims, 4 Drawing Sheets

VISOR CAP WITH RETRACTABLE PROTECTIVE VISOR

This invention relates to peak or visor (billed) caps worn by humans.

BACKGROUND OF THE INVENTION

Peak or visored caps are worn by golfers, baseball players, house painters, construction workers, and recreational endeavors.

The hats or caps have a generally crown or dome shaped shell which fits over the upper portion of the head. The lower edge of the shell extends down close to the top of the ears. A visor or bill attached to the shell's lower edge extends forward normally about one and one half to five and one-half inches, with three inches about average. The visor or bill usually has a width of about six to eight inches, with seven inches about average. The cap shell is usually made of cloth or plastic, which can be insulated for warmth, or partially or wholly of an open mesh material for wear in warm climates where ventilation is desirable. In case of the plastic hat for overhead or motorized protection, the visor is often made of one or more layers of cloth sewn together, with or without an internal sheet of cardboard, plastics or other stiffening material.

The purpose of the visor is to protect the wearers face against rain, snow, wind and sunlight, which could cause poor vision or sunburn and harm to the eyes. While the normal visor provides adequate protection against the described elements, there are times when the vision or a worker may be blocked by the visor, such as when one is working on objects that are overhead. Similarly, in narrow corridors or tight quarters, the standard length visor may strike the walls or other protruding objects. The present invention overcomes these difficulties because the fixed portion of the visor is approximately one-half the length of a standard visor so that when the extendible visor is retracted, vision and working space are no longer affected. The moveable visor can be made of different color see through plastics or solid color plastics or of any hard material comparable. The shell is molded or constructed in a permanent curve and the visor is produced flat, when the visor is inserted into the shell there is a natural induced bind or friction that holds the visor at any extension whether it is half or fully extracted from the closed position.

U.S. Pat. No. 1,610,745 discloses a cap with a permanent visor having an extendable visor in a pocket between two adjacent layers forming a permanent visor. Flexible strings or cords stop forward movement but there is no means to hold the visor extended or in the out position. There is a need for an improved hat for working overhead with the means to hold the extension at any position.

SUMMARY OF THE INVENTION

A cap to be worn on the head of a person, comprising a generally shaped crown or dome shell, having a lower edge, which fits over the upper portion of the head of a person (male or female, child or adult) a permanent visor which is hollow or consisting of a upper and lower part is attached to that portion of the shell lower edge which contacts the forehead and extends outwardly therefrom, an extendible visor is inserted into the shell or hollow casing of the permanent bill or visor which is stored inward or retracted into the shell or hollow permanent bill or visor. This retractable visor can be brought forward to a full extended position at which it effectively increases the length of the permanent cap bill or visor. The shell or hollow portion of the cap includes slots or hollow runners that the visor or retractable portion of the bill or visor is guided back and forward in the shell or permanent portion of the attached cap bill or visor. The movable visor has pins or raised permanent dowels that fit into the slots or hollow runners that guide the visor in the retracted and extended position. The shell is manufactured in a permanently curved crescent shape that fits the forehead of a person and the visor is manufactured flat, when the visor (flat) is inserted into the shell (crescent shaped) and the pin's insert into the guide slots. There is a natural bind or friction that holds the visor at any position firmly, whether the visor be in a stored position or fully extended or any position between.

DETAILED DESCRIPTION OF THE DRAWINGS

Figure 1:
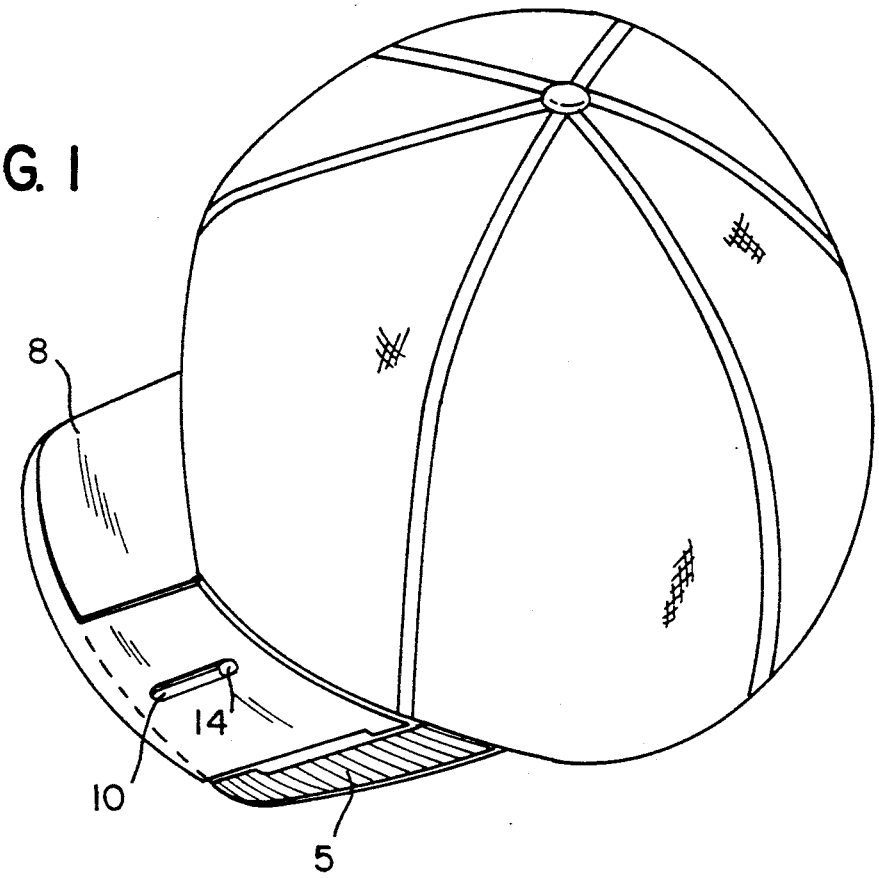
FIG. 1 is a side view, partially broken away and in section of one embodiment of a cap provided by the invention with an extendible visor in stored position.
Figure 2:
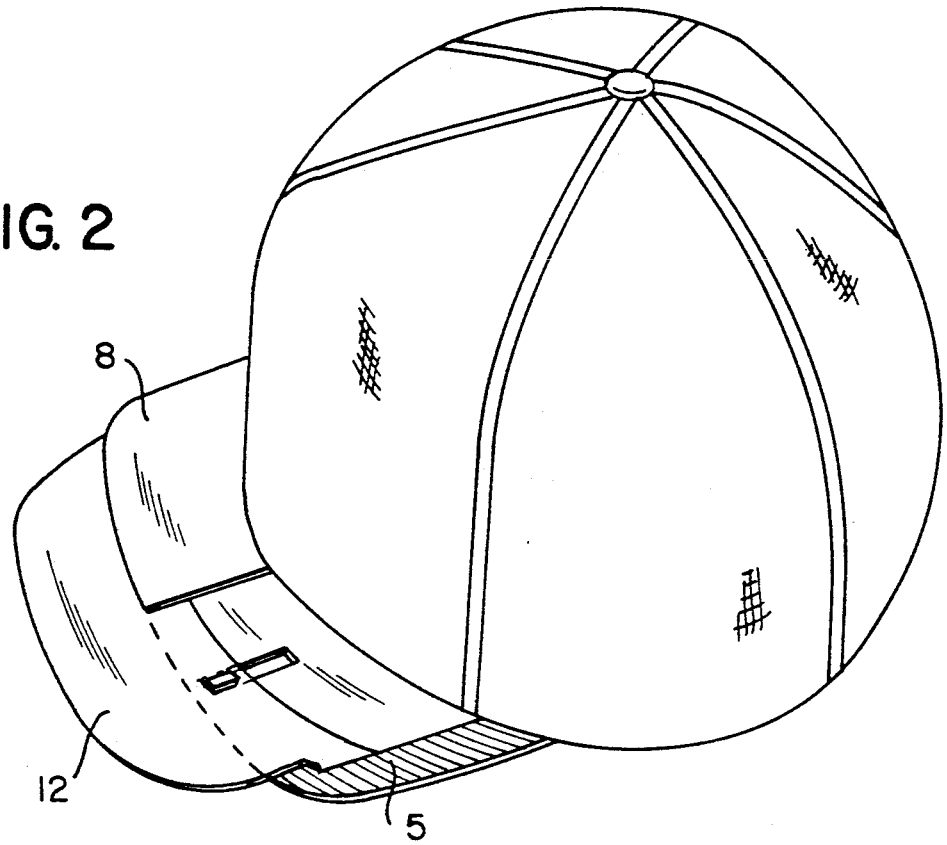
FIG. 2 —Is a sectional view of the cap shown in FIG. 1 but with the extendable visor in the extended position.

Referring now to the drawings. FIGS. 1 and 2 show a common visor cap. This type of hat has a generally domed shape crown which fits over the upper portion of the head. Normally, the visor extends to between about three inches and five and one-half inches. The cap shell is usually made of cloth or plastic. In the instant invention, the normal bill is replaced with an extendible visor system. The system consists of an outer visor that has a top and a bottom that are connected, which form a pocket which holds the section visor. FIG. 1 shows the second visor retracted within the pocket. FIG. 2 shows the second visor extended from the pocket.

In the preferred embodiment, the outer visor is approximately one and one half inches long. The second visor can be extended beyond that to approximately three inches long.

Figures 3, 4:
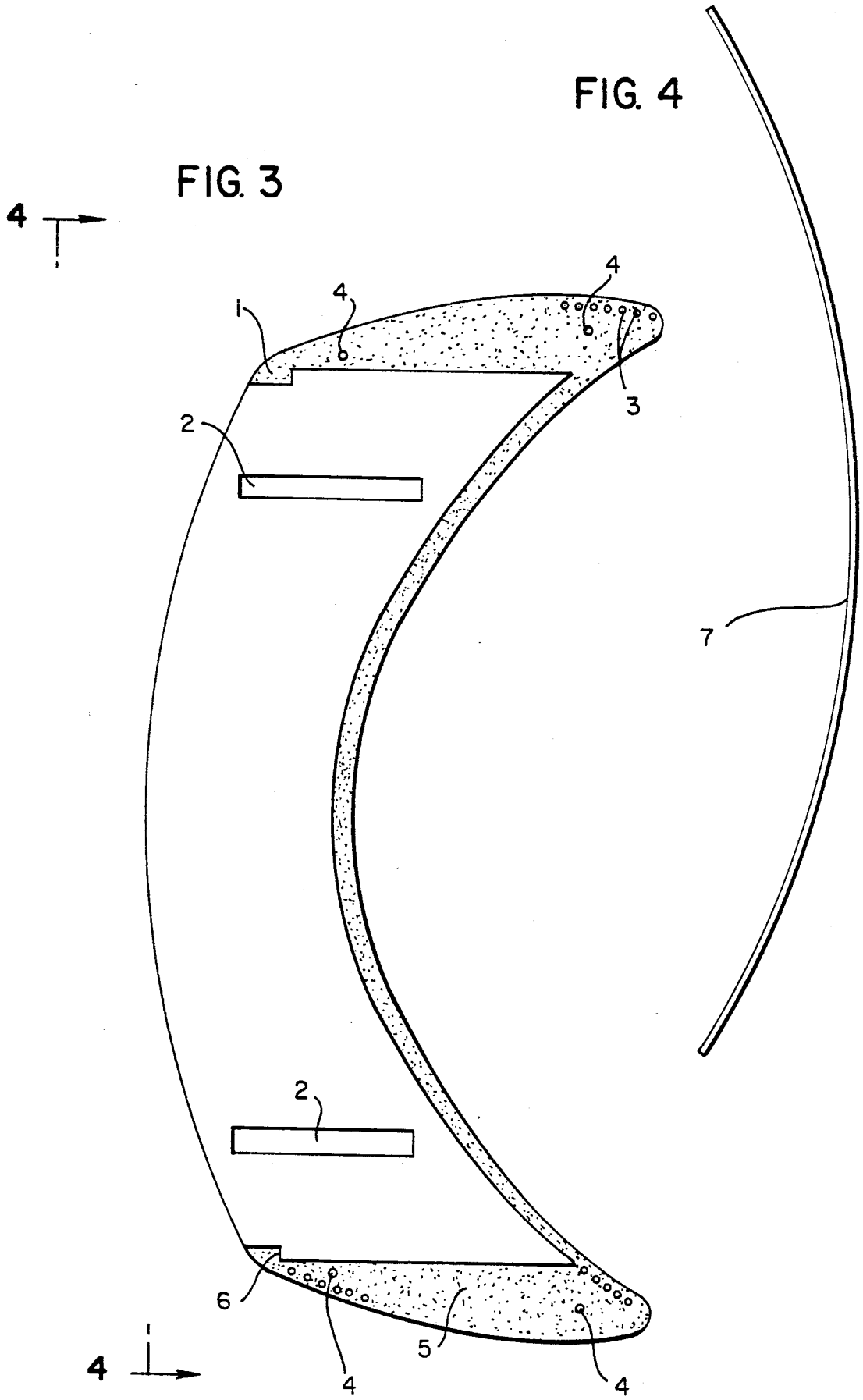
FIG. 3 —Bottom view of the permanent affixed shell or pocket that holds the movable visor.
FIG. 4 —Is a side view of FIG. 3.
Figure 5:
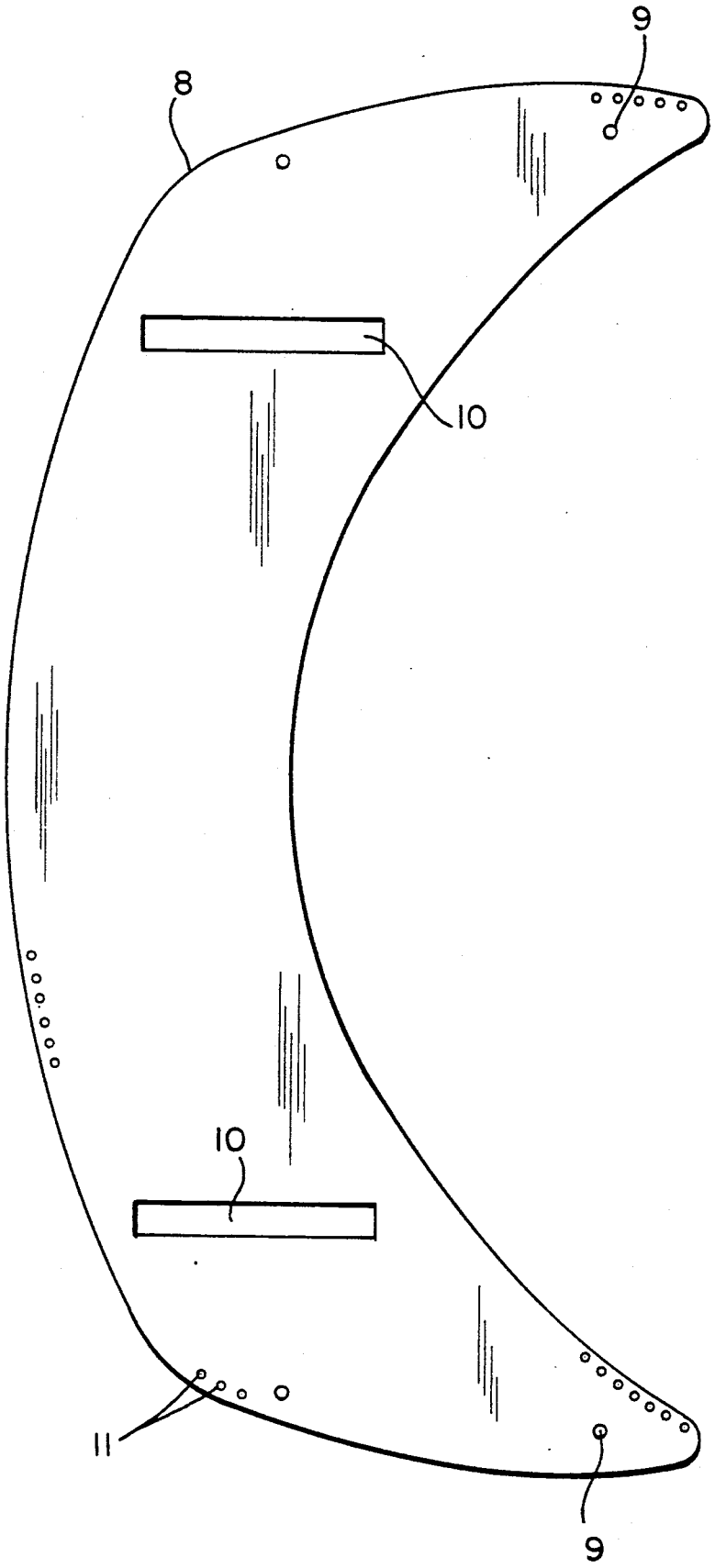
FIG. 5 —Is a top view of the permanent visor.
Figure 6:
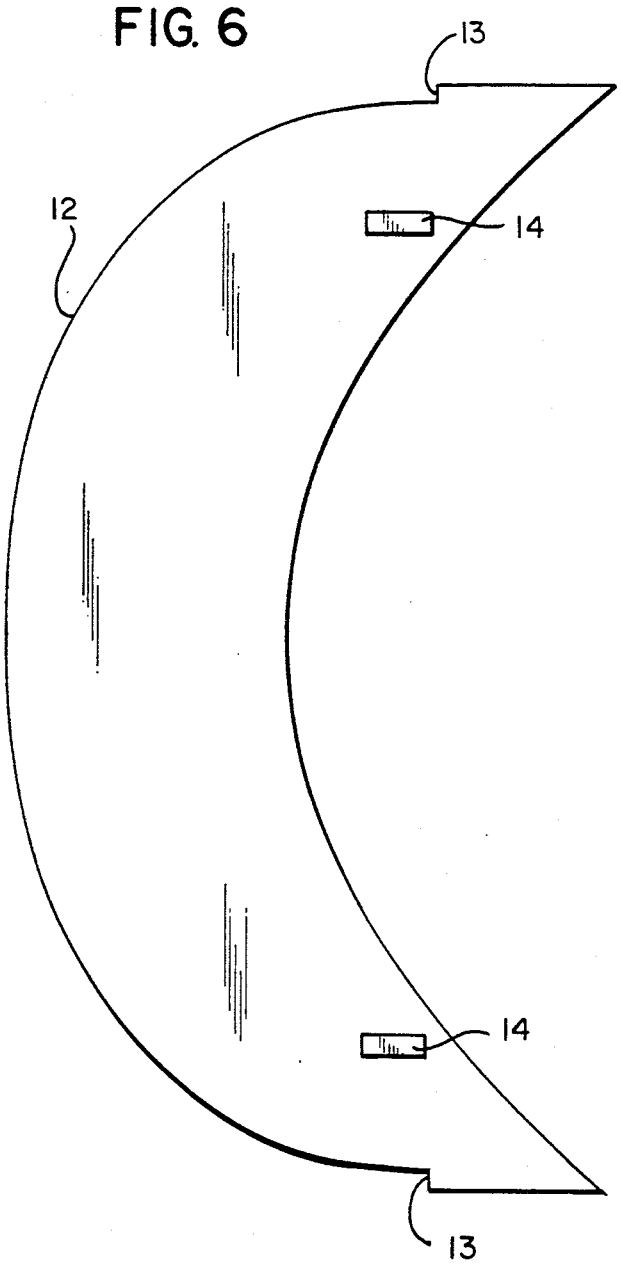
FIG. 6 —Is the top view of the movable visor that is inserted into the permanent bill or visor.
Figure 7:
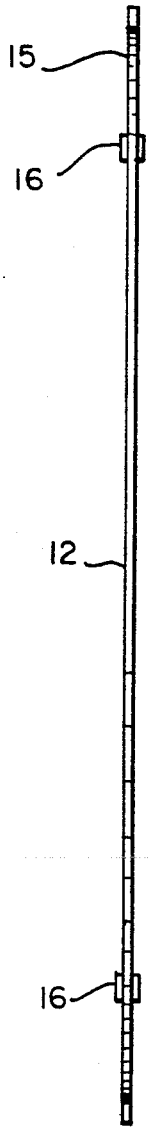
FIG. 7 —Is a side view of the movable visor.

Number 1 of FIG. 3, sheet 2 of 4, shows the bottom view of the shell or pocket that is sewn or affixed into the permanent bill or visor of the cap that cradles the movable visor. Number 2, of FIG. 3, sheet 2 of 4, shows the grooves of notches or guides that function as a lock-in for the pins or dowels that slide forward or in reverse for the movable visor. Number 3, depicts spaced holes in the permanent visor for the sewing of the cloth material over the visor. Number 4, shows the position of press fit pins that snap the top visor portion to the bottom portion of the visor in order to hold the two pieces in the correct position for sewing the cloth over the visor. Number 5, depicts shadowed areas on the bottom half of the visor that represent the raised part of the visor that when the top visor is fitted to the bottom, therein forms a pocket or hollow space to cradle the movable visor that is inserted. Number 6, depicts a notch or secondary stop built into the raised portion of the permanent visor to limit the movement of the movable visor's forward travel. FIG. 4, sheet 2 of 4, number 7, represents the arc, or molded shape and/or curve of the permanent visor that holds the movable visor. FIG. 5, sheet 3 of 4, number 8, depicts the top view of the permanent visor that is married and/or joined to the bottom visor as shown in FIG. 3 sheet 2 of 4, number 1. Number 9 represents the press-fit pinholes (female end) that the press fit pins are inserted into to join/and/or connect the top to the bottom so that they form the permanent pocket and/or cradle that holds the movable visor. Number 10, depicts the slots and/or grooves that the pins that are fixedly installed in the movable visor (as shown in FIG. 6, sheet 4 of 4, number 14) move backwards and forwards acting as guides and stops. Number 11, shows spaced holes that are used for sewing the material to the permanent visor also shown in FIG. 3, sheet 2 of 4, number 3, these holes are spaced all around the sides of the top and bottom permanent visor halves for the purpose of sewing cloth on the visor. FIG. 6, sheet 4 of 4, number 12, depicts the movable visor that inserts into the pocket formed by the permanent visor. Number 13, shows wherein the movable visor will butt and/or rest against the notch and/or secondary stop to hold and arrest the movable visor when fully extended in the outward position (as depicted in FIG. 3, sheet 2 of 3, number 6). Number 14, shows the pins or dowels that ride in the slots and/or grooves that guide and stop the movement of the movable visor. FIG. 7, sheet 4 of 4, number 15, is a side view of the movable visor. Number 16, is a side view of the pins or dowels that are described in number 14, sheet 4 of 4.

The foregoing detailed description has been given for clarity of understanding only, and no unnecessary limitations should be understood therefrom, as modifications will be obvious to those skilled in the art.

I claim:

1. A cap to be worn on a head of a person comprising:

(a) a generally hemispherical shell having a lower edge, said shell being sized to fit the head of the person;

(b) a first visor, fixedly attached to the lower edge of the hemispherical shell and extending outwardly and perpendicularly thereform, said visor having a top piece and a bottom piece being connected together thereby forming a pocket therein;

(c) a second visor having essentially the same shape as the first visor, but being slightly smaller to permit said second visor to fit within said pocket of said first visor to permit the second visor to be extended outwardly therefrom to a forward position, which effectively increases the length of the first visor, or to permit the second visor to be retracted from the outward position for storage, said second visor being held in either the outward position or the inward position by friction;

(d) slots formed within the pocket of said first visor, said slots being parallel to the direction of travel of said second visor; and (e) pins being fixedly installed on the second visor such that the pins are aligned within the slots and such that the outward travel of the second visor is stopped when the pins contact the end of the slots, said pins and slots being used to restrict the outward and inward travel of said second visor.

2. The cap of claim 1 wherein the second visor is constructed of a transparent, colored plastic.

3. The cap of claim 1 wherein the second visor is constructed of an opaque plastic.

* * * * *